US009179210B2

(12) United States Patent
Schwager

(10) Patent No.: US 9,179,210 B2
(45) Date of Patent: Nov. 3, 2015

(54) HEADPHONE CABLE ARRANGEMENT, FILTER ASSEMBLY, AND METHOD OF FILTERING SIGNALS IN HEADPHONE CABLE ARRANGEMENTS

(71) Applicant: Sony Corporation, Tokyo (JP)

(72) Inventor: Andreas Schwager, Waiblingen (DE)

(73) Assignee: SONY CORPORATION, Tokyo (JP)

( * ) Notice: Subject to any disclaimer, the term of this patent is extended or adjusted under 35 U.S.C. 154(b) by 399 days.

(21) Appl. No.: 13/720,337

(22) Filed: Dec. 19, 2012

(65) Prior Publication Data

US 2013/0170664 A1 Jul. 4, 2013

(30) Foreign Application Priority Data

Dec. 29, 2011 (EP) ..... 11010277

(51) Int. Cl.
*H04R 1/10* (2006.01)

(52) U.S. Cl.
CPC ..... *H04R 1/1033* (2013.01)

(58) Field of Classification Search
CPC ..... H04R 1/1033
USPC ..... 381/74, 94.1, 120, 123
See application file for complete search history.

(56) References Cited

U.S. PATENT DOCUMENTS

| | | | | |
|---|---|---|---|---|
| 7,558,607 | B2 | 7/2009 | Edeler et al. | |
| 2009/0147982 | A1 | 6/2009 | Ashida et al. | |
| 2009/0310798 | A1 * | 12/2009 | Ullen et al. | 381/94.1 |
| 2010/0272294 | A1 * | 10/2010 | Arknaes-Pedersen et al. | 381/120 |
| 2013/0101141 | A1 * | 4/2013 | McElveen | 381/123 |

OTHER PUBLICATIONS

"PmodAMP1™ Speaker/Headphone Amplifier Reference Manual", Digilent, www.digilentinc.com, Apr. 27, 2007, pp. 1-2.
Chu Moy, "Active Noise Reduction Headphone Systems", Technical Papers Library, 2001, 8 Pages.

* cited by examiner

*Primary Examiner* — Md S Elahee
(74) *Attorney, Agent, or Firm* — Oblon, McClelland, Maier & Neustadt, L.L.P.

(57) ABSTRACT

A headphone cable (150) is connected to a headphone set (190) with one, two or more loudspeakers (191, 192). The headphone cable (150) includes at least a first signal wire (151) and at least one reference line (152, 154). An electronic filter unit (110) performs a filtering, e.g. a common mode filtering, which is effective on at least one of the signal wires and reference lines (151, 153). A differential audio signal between a signal wire and a reference line (152, 154) is passed. Common mode signals except signals within a VHF radio band may be attenuated. The electronic filter unit (110) may be arranged in a connector case (129) of a headphone connector (120) provided at a connector end of the headphone cable (150) or in a pluggable filter assembly (130) provided between the mobile electronic device (200) and the headphone cable (150).

10 Claims, 6 Drawing Sheets

HEADPHONE CABLE ARRANGEMENT, FILTER ASSEMBLY, AND METHOD OF FILTERING SIGNALS IN HEADPHONE CABLE ARRANGEMENTS

CROSS REFERENCE TO RELATED APPLICATION

The present application claims the benefit of the earlier filing date of 11 010 277.9 filed in the European Patent Office on Dec. 29, 2011, the entire content of which application is incorporated herein by reference.

FIELD OF INVENTION

Embodiments of the present invention relate to a headphone cable arrangement, a filter assembly, and a method for filtering signals in a headphone cable arrangement.

BACKGROUND OF THE INVENTION

Mobile electronic devices provide audio signals that may be reproduced for the user by means of headphones or earplugs. A headphone cable couples the headphones to the mobile electronic device. Mobile electronic devices often provide a VHF (very high frequency) receiver for receiving broadcast radio signals using the headphone cable as an FM antenna to pick up radio signals and to couple them to the VHF receiver.

The object of the invention is to provide an improved headphone cable arrangement providing a more pleasant audio reproduction. The object is achieved with the subject-matter of the independent claims. Further embodiments are defined in the dependent claims, respectively. Details and advantages of the invention will become more apparent from the following description of embodiments in connection with the accompanying drawings. Features of the various embodiments may be combined unless they exclude each other.

Figure 1:
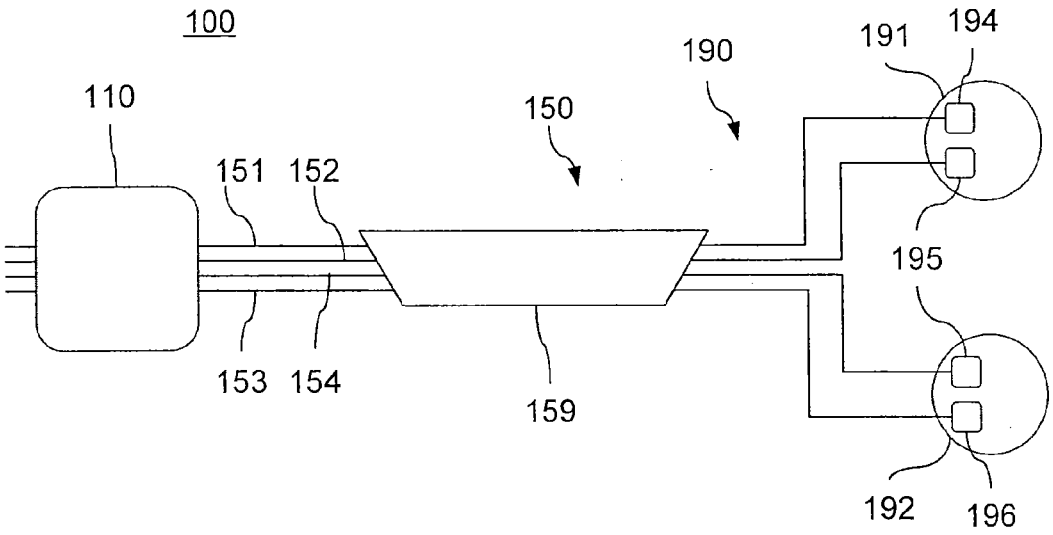
FIG. 1 is a schematic block diagram of a headphone cable arrangement according to an embodiment.

The headphone cable arrangement 100 of FIG. 1 includes a headphone cable 150. The headphone cable 150 may contain at least two signal wires 151, 153 and at least one reference line 152, 154. The signal wires 151, 153 are embedded in insulating material. The at least one reference line 152, 154 may be a wire or may be plaited in a cable sheath. For example, the headphone cable 150 may include two separated reference wires. The headphone cable 150 may include further signal wires, for example a signal wire for control of a mobile electronic device connected to the headphone cable arrangement 100 or signals for providing noise cancellation.

In this example, a headphone set 190 including a first and a second loudspeaker 191, 192 is connected to a headphone end of the headphone cable 150. In other examples, e.g. in the case of surround sound applications and active speaker being connected to the phone, multiple (i.e. more than two) loudspeakers might be connected to the headphone end. The loudspeakers 191, 192 may be integrated in headphones, earphones, earplugs or separate active speaker boxes. According to an embodiment, the headphone set 190 may be adapted to provide noise cancellation. The first signal wire 151 is connected to a first terminal 194 of the first loudspeaker 191, and a first reference line 152 may be connected to a second terminal 195 of the first loudspeaker 191. The second signal wire 153 is connected to a first terminal 196 of the second loudspeaker 192, and a second reference line 154 may be connected to a second terminal 195 of the second loudspeaker 192. The signal wires 151, 153 supply audio signals to the first and second loudspeakers 191, 192. The audio signals may be differential signals applied between the respective signal wire 151, 153 and corresponding reference lines 152, 154. At least one of the signal wires 151, 153 or reference lines 152, 154, for example one of the reference lines 152, 154 or both or a shield connected to the second terminals 195 of the first and second loudspeakers 191, 192, is operated to pick up broadcast VHF radio signals.

An electronic filter unit 110 performs a filtering which is effective on at least one of the signal wires 151, 153 and reference lines 152, 154, for example on that or those signal wire(s)/reference line(s) which is/are operated as VHF antenna. The electronic filter unit 110 is arranged at a connector end of the headphone cable 150. The electronic filter unit 110 passes frequencies of a VHF radio band, whereas at least frequencies beyond the VHF radio band or frequencies below the VHF radio band are attenuated. According to an embodiment, the electronic filter unit 110 attenuates a frequency band below the VHF radio broadcast band. The attenuated frequency band may or may not contain the audible frequency band of 15 Hz to 15 kHz. The filtering may provide a common mode filtering. The VHF radio band has an upper frequency limit of 108 MHz or less.

According to an embodiment, the electronic filter unit 110 filters frequencies above the upper frequency limit of the audible signal and below the lower frequency limit of the VHF radio band, for example frequencies below 87.5 MHz or lower. According to another embodiment, the lower frequency limit of the passed VHF radio band is 87.5 MHz and the upper frequency limit is 108 MHz. Since some regions do not use the complete VHF radio band, the electronic filter unit 110 may be tuned more exactly to the respective region and may pass a VHF radio band with a lower frequency limit above 87.5 MHz and/or an upper frequency limit below 108 MHz. According to another embodiment, the passed VHF radio band has a lower frequency limit of 76 MHz and an upper frequency limit of 90 MHz. In accordance with another embodiment, the electronic filter unit 110 is or contains a common mode band-stop effective in a frequency range between the upper frequency limit of the audible frequency band and the lower frequency limit of the VHF radio band.

For data transmission in powerline networks PLC (power line communication) modems use VHF frequencies near the VHF radio band, for example close to the lower frequency limit or the higher frequency limit of the VHF radio band. Some mobile electronic devices with an FM tuner functionality do not provide filtering for suppressing out-of-band noise and may not filter sufficiently strong signals emitted from PLC networks close to the VHF radio band. The headphone cable arrangement 100 with the integrated electronic filter unit 110 suppresses disturbances resulting from, for example, PLC modems and removes such interferences.

Loud signals appearing at frequencies outside the VHF radio band, which is 87.5 MHz to 108 MHz in Europe and 76 MHz to 90 MHz in Japan, may cause interference to FM broadcast radio reception when not sufficiently filtered. Where PLC modems use high feeding limits and the radio receiver does not implement out-of-band filters, which is the case for some smart phones or walkman types, the electronic filter unit 110 in the headphone cable arrangement 100 attenuates signals outside the VHF radio band.

The electronic filter unit 110 may be effective in a single one of the signal wires/reference lines 151-154 or in more than one of the signal wires and reference lines 151-154. According to an embodiment, the electronic filter unit 110 is in the same way effective for all of the signal wires and reference lines 151-154.

According to an embodiment, the electronic filter unit 110 is a common mode low-pass filter with a cut-off frequency of 90 MHz or higher. According to another embodiment, the electronic filter unit 110 is a common mode high-pass filter, which attenuates frequencies below the VHF radio band. The electronic filter unit 110 may be a combination of a band-stop filter and a low-pass filter, for example a combination of a common mode band-stop filter and a common mode low-pass filter.

Figure 2:
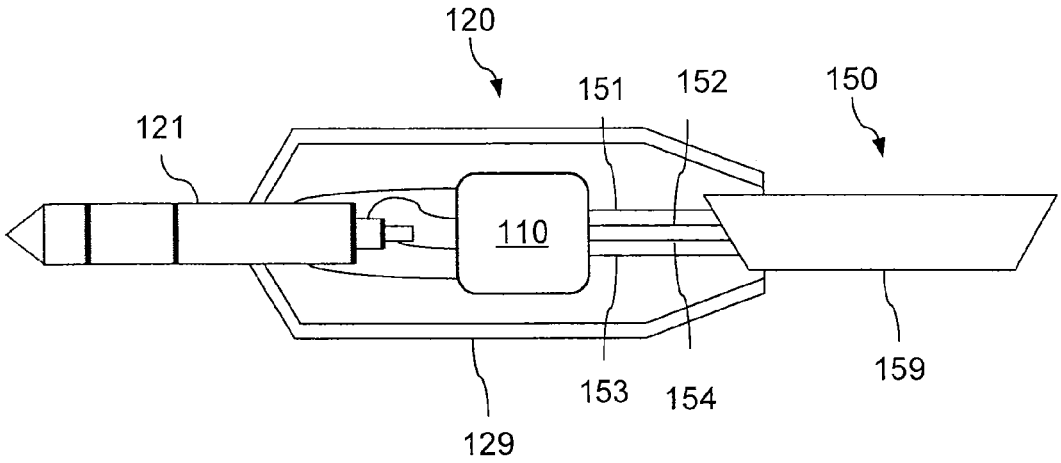
FIG. 2 is a schematic block diagram of a headphone connector including an electronic filter unit according to another embodiment of the invention.

FIG. 2 refers to an embodiment with an electronic filter unit 110 integrated in a headphone connector 120 provided at a connector end of the headphone cable 150. A first signal line 151 of the headphone cable 150 is connected via a low-resistance path to a first terminal of the headphone connector 120. A second signal line 153 is connected via a low-resistance path to a second terminal of the headphone connector 120. At least one reference line 152, 154 is connected to a third terminal of the headphone connector 120. According to an embodiment two reference wires are connected to the same third terminal via the electronic filter unit 110.

The headphone connector 120 comprises a connector case 129 housing the electronic filter unit 110 and encapsulating the connections between the respective signal wires/reference lines 151-154 and the electronic filter unit 110 and the connections between the electronic filter unit 110 and the terminals of the headphone connector 120. A terminal portion 121 provides terminal contacts, which provide electric contact to a matching connector integrated in a mobile electronic device. According to an embodiment, the terminal portion 121 is a jack plug protruding from the connector case 129 such that the terminal contacts are arranged outside the connector case 129. For example, the headphone connector 120 may be of the TRS (tip-ring-sleeve) type. According to another embodiment, the headphone connector 120 may be a TRRS (tip-ring-ring-sleeve) connector with reference lines connected to different terminal contacts or with a further control wire integrated in the headphone cable 150 and connected to an additional terminal connector. The headphone connector 120 may e.g. be a stereo plug, a mini-jack, a mini-stereo jack, a headphone jack, a telephone connector or a bottom plug, for example a 2.5 mm or 3.5 mm TRS or TRRS jack plug.

Figure 3A:
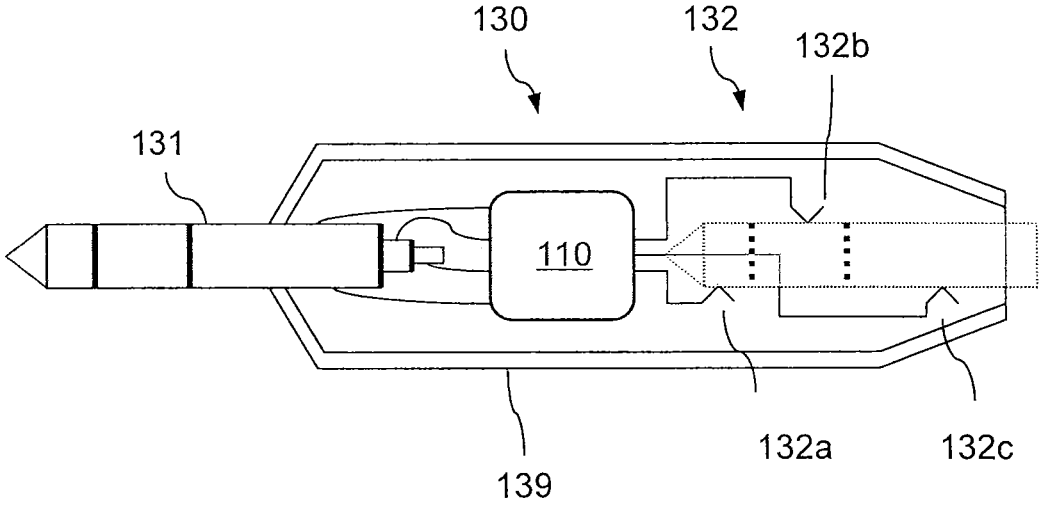
FIG. 3A is a schematic block diagram of a pluggable filter assembly including an electronic filter unit in accordance with a further embodiment.

FIG. 3A refers to a headphone cable arrangement comprising a standard, non-modified headphone cable including a standard jack plug and an adapter-like pluggable filter assembly 130. The pluggable filter assembly 130 comprises an assembly case 139 with a first pluggable assembly connector 131 adapted to be plugged and coupled to a standard connector of a mobile electronic device and a second pluggable assembly connector 132 that matches and is pluggable to the connector of a standard headphone cable. The assembly case 139 houses the electronic filter unit 110 and the connections between the electronic filter unit 110 and the first assembly connector 131 and the second assembly connector 132. Second terminal contacts 132*a*, 132*b*, 132*c* provide contact to the signal wires and reference lines of the headphone cable. According to an embodiment, the first assembly connector 131 is a male connector, for example a jack plug, and the second assembly connector 132 is a female connector, for example a jack socket.

Figure 3B:
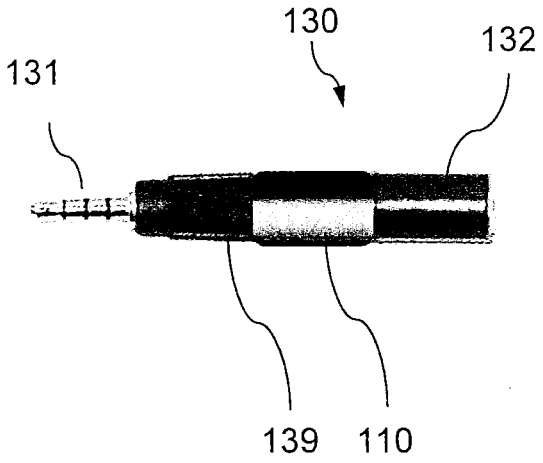
FIG. 3B is a schematic perspective view of a pluggable filter assembly according to another embodiment.

FIG. 3B shows a pluggable filter assembly 130 to be inserted between a standard headphone cable and a mobile electronic device. The integrated electronic filter unit 110 attenuates signals outside the VHF radio band, for example below the VHF radio band. The filter assembly 130 has a female jack (jack socket) on the one side and a male jack (jack plug) on the other side.

Figure 3C:
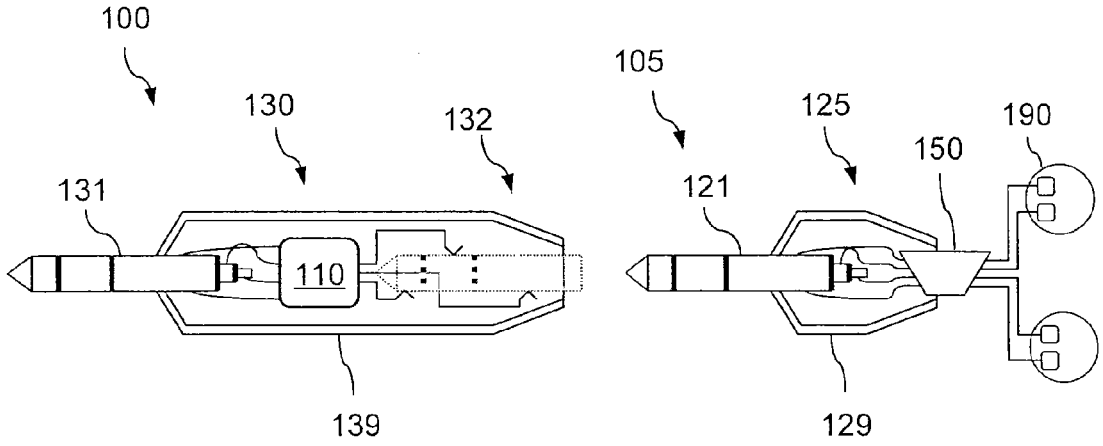
FIG. 3C is a schematic block diagram of a headphone cable arrangement according to an embodiment including a pluggable filter assembly.

FIG. 3C shows an embodiment combining the pluggable filter assembly 130 of FIG. 3A with a standard headphone cable set 105 to form a headphone cable arrangement 110. The pluggable filter assembly 130 corresponds to the filter assembly of FIG. 3A. The standard headphone cable 105 comprises a headphone cable 150 with a headphone set 190 providing a first and a second loudspeaker 191, 192 provided at a headphone end and a standard headphone connector 125 at a connector end of the headphone cable 150. The standard headphone connector 125 houses connections between the signal wires/reference lines of the headphone cable 150 and the terminals of a terminal portion 121 of the standard headphone connector 125. The first assembly connector 131 of the pluggable filter assembly 130 is pluggable and matches with a headphone connector in a mobile electronic device and the second assembly connector 132 is pluggable and matches with the standard headphone connector 121. According to an embodiment, the standard headphone connector 121 may be of the same type as the first assembly connector 131. According to other embodiments, the first assembly connector 131 and the headphone connector 121 are different, for example have different sizes or types.

Figure 4:
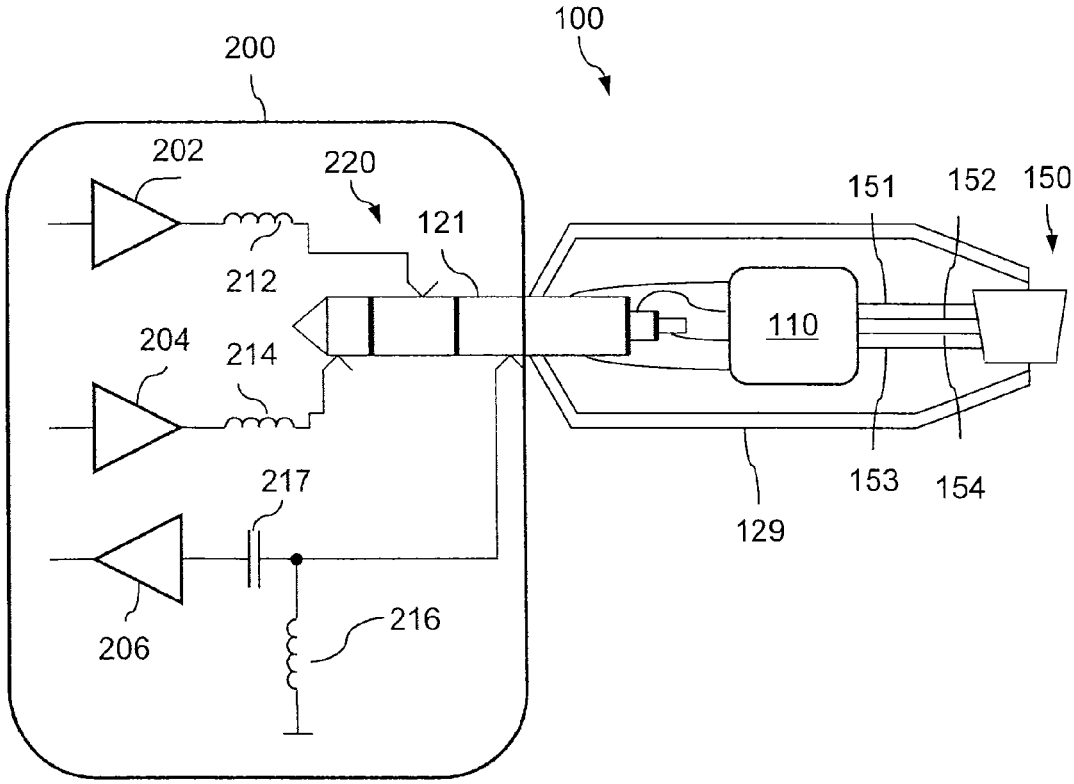
FIG. 4 is a schematic block diagram showing a portion of a headphone cable arrangement coupled to a mobile electronic device.

FIG. 4 shows a headphone cable arrangement 100 in electrical and mechanical contact with an electronic mobile device 200. The mobile electronic device 200 may be a cell phone, a smart phone, a personal digital assistant, a walkman, a tablet computer, or a handheld computer and includes a radio receiving unit adapted to receive radio broadcast signals of the VHF radio band. For example, the electronic mobile device 200 comprises a VHF input stage 206 that selects and amplifies radio frequency signals of the VHF radio band. A high-pass filter with a capacitive element 217 arranged in series and an inductive element 216 arranged in parallel connects the input of the VHF input stage 206 with a contact of a headphone connector 220, which may be a female jack socket, by way of example.

The mobile electronic device 200 is further adapted to output left-channel and right-channel audio signals via audio frequency amplifiers 202, 204 to further contacts of the headphone connector 220. Inductive elements 212, 214 may be arranged in series between the outputs of the audio frequency amplifiers 202, 204 and the contacts, respectively, in order to decouple the audio frequency amplifiers 202, 204 from high frequencies.

The headphone cable 150 is effective as an antenna and picks up radio signals of the VHF radio band. The capacitive element 217 provides a high frequency connection for the received VHF radio signals and supplies the signals to the VHF input stage 206. The audio frequency amplifiers 202, 204 output audio signals via the headphone cable 150 to headphones connected to a headphone end of the headphone cable 150.

The headphone cable arrangement 100 includes an electronic filter unit 110 which may be effective as a band stop for frequencies below the VHF radio band, for example between the audible frequency band and the VHF radio band.

Figure 5:
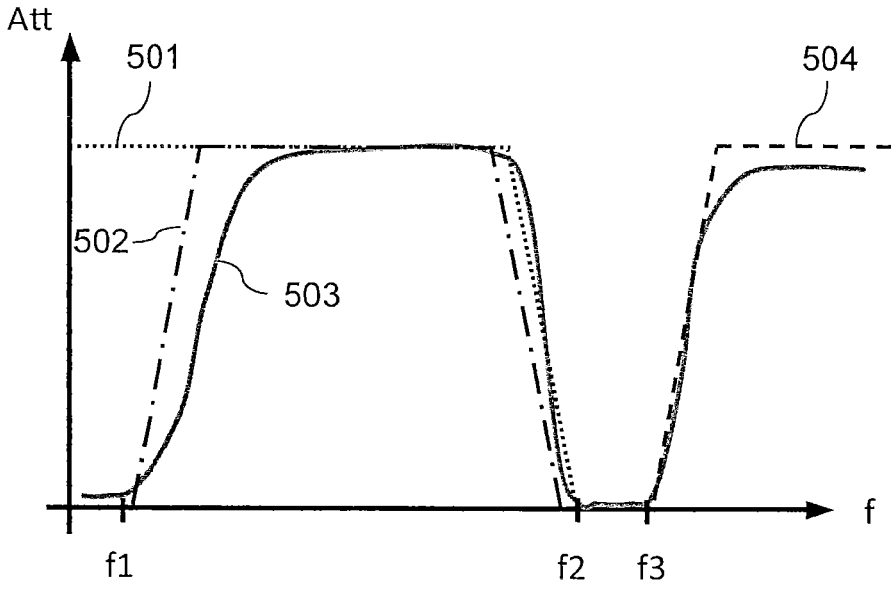
FIG. 5 is a schematic diagram showing filter curves of electronic filter units according to further embodiments.

In FIG. 5, reference sign 501 indicates a characteristic curve of an electronic filter unit being effective as a high-pass with a cut-off frequency at or below the lower frequency limit f2 of the VHF radio band. Reference sign 504 refers to the characteristic curve of an electronic filter unit being effective as a low-pass with a cut-off frequency at or below the upper frequency limit f3 of the VHF radio band. The cut-off frequency may be 108.5 MHz or lower, for example 90 MHz. Reference sign 502 shows the characteristic curve of an embodiment of an electronic filter unit being effective as a band-stop filter attenuating frequencies between the upper frequency limit f1 of the audible frequency range and the lower frequency limit f2 of the VHF radio band. According to an embodiment, the lower frequency limit f2 of the VHF radio band is 80 MHz or higher. According to another embodiment, the lower frequency limit f2 of the VHF radio band is 76 MHz. The upper edge of the audible frequency is 15 or 20 kHz. Reference sign 503 refers to the characteristic curve of an electronic filter unit combining the filter characteristics of a low-pass and a band-stop filter.

The audible frequencies, for example up to 18 kHz, are not attenuated because the cable is used as headphone cable. Further, the VHF radio band is not attenuated. All other frequencies are suppressed. The VHF radio band has a width between 14 MHz and 21 MHz. The VHF radio band contains a frequency of 90 MHz. For example, the VHF band is from 87.5 MHz to 108 MHz or a subrange thereof or between 76 MHz and 90 MHz. Conventionally, the audio signals supplied to a headphone cable are differential mode signals. If the headphone cable is effective as an antenna, the received VHF signals are common mode signals on all wires. The electronic filter unit could be a common mode VHF band-pass that attenuates all common mode signals except the VHF band, a common mode low-pass with cut frequency above the upper frequency limit of the VHF radio band or a high-pass with a cut-off frequency at or below the lower frequency edge of the VHF radio bands.

Figure 6:
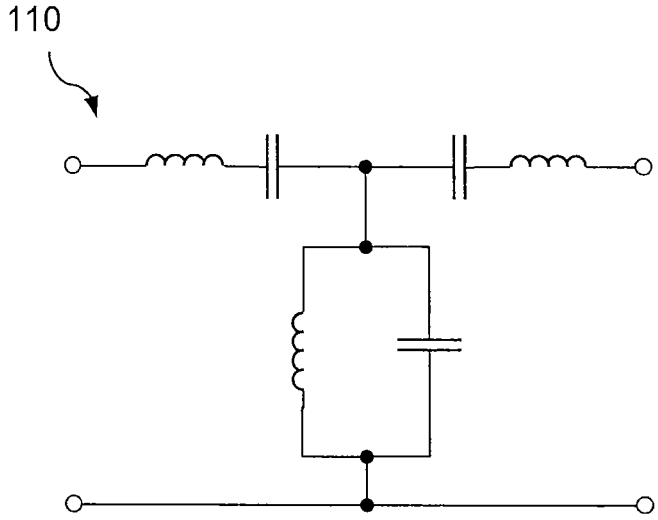
FIG. 6 is a schematic circuit diagram of an electronic filter unit according to an embodiment.

According to an embodiment, the electronic filter unit may be implemented as band-pass using passive components as shown in FIG. 6. According to an embodiment, several filters may be cascaded to improve the attenuation.

Figure 8:
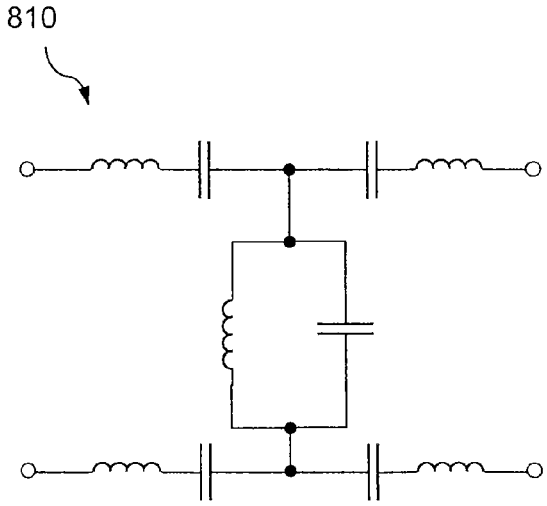
FIG. 8 is a schematic circuit diagram of an electronic filter unit for a pair of signal wires/reference lines.
Figure 9:
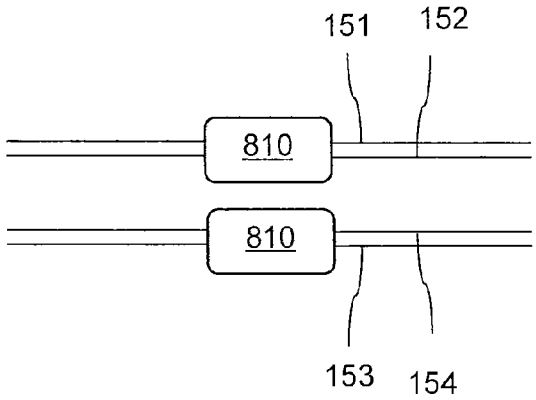
FIG. 9 is a schematic circuit diagram of an electronic filter unit including for two pairs of signal wires/reference lines.
Figure 10:
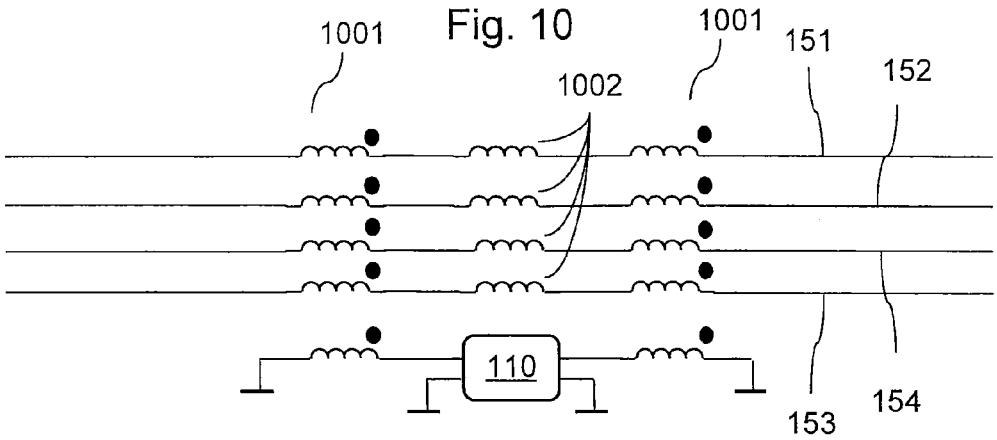
FIG. 10 is a schematic circuit diagram of an electronic filter unit providing a common mode filter stage.

Options to realize filters with the shape as characterized in FIG. 5 are shown in FIGS. 9 and 10. In FIG. 9 each of two signal/reference lines (151+152, 153+154) are filtered using a filter unit 810 as shown in FIG. 8. The filter unit 810 attenuates unwanted frequencies as described above.

FIG. 10 shows a filter unit where the Common Mode signals are separated from the signals lines using a CM-choke 1001. The signal lines are low-pass filtered to select the audio frequencies using e.g. additional chokes 1002 for each line. The CM path is filtered by a filter unit 110 and shown in FIG. 6. Here only the FM broadcast frequencies remain in the CM path after the band pass 110. Finally the CM path is added again to the other lines using a $2^{nd}$ CM choke 1001.

Figure 7:
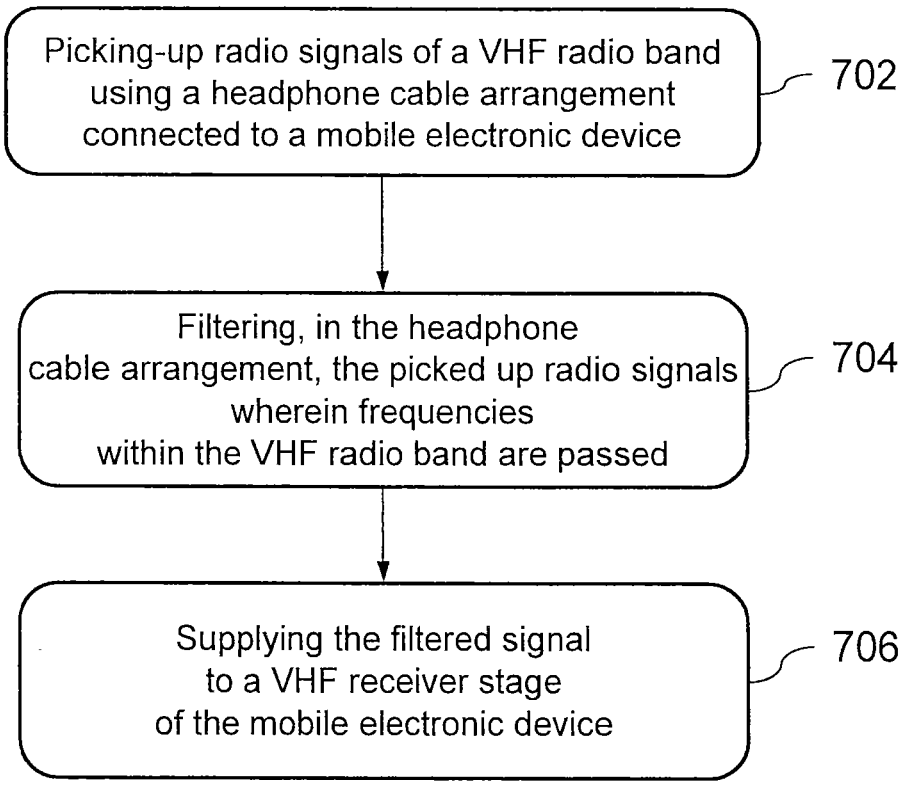
FIG. 7 is a simplified flowchart of a method of filtering signals in a headphone cable arrangement in accordance with a further embodiment.

FIG. 7 refers to a method of operating a headphone cable arrangement for a mobile electronic device. A headphone cable of a headphone cable arrangement connected to a mobile electronic device that comprises a VHF receiver stage and audio amplifiers picks up radio signals of a VHF radio band (702). The headphone cable arrangement filters signals, for example common mode signals, wherein frequencies within a VHF radio band are passed and at least some of the frequencies below or above the VHF radio band are rejected (704). The filtered signal is supplied to the VHF receiver stage of the mobile electronic device (706). Audio signals are transmitted from the audio amplifiers to a headphone set of the headphone cable arrangement.

According to an embodiment a headphone cable arrangement includes a headphone cable with one or more signal wires and at least one reference line. At a headphone end, the headphone cable is adapted to be connected with one or more loudspeakers, wherein a first signal wire of the one or more signal wires is adapted to be connected to a first one of the one or more loudspeakers. An electronic filter unit is configured to perform a filtering effective on at least one of the signal wires and reference lines, wherein frequencies of a VHF radio band are passed and at least one frequency band below or above the VHF radio band is attenuated. The electronic filter unit is arranged at a connector end of the headphone cable. The headphone cable arrangement may include a headphone connector provided at the connector end of the headphone cable. According to a first alternative, the one or more signal wires and reference lines are connected to terminal contacts of the headphone connector via the electronic filter unit. According to another alternative, the one or more signal wires and reference lines are connected directly to the terminal contacts and the electronic filter unit is provided in a pluggable filter assembly pluggable between the headphone connector of, for example a handheld portable electronic device, and the headphone connector of the headphone cable.

The invention claimed is:

1. A pluggable filter assembly comprising:

a first pluggable assembly connector matching with a headphone connector of a mobile electronic device, the pluggable filter assembly being to be connected to the headphone connector of the mobile electronic device via the first pluggable assembly connector;

a second pluggable assembly connector that includes a plurality of contacts that provide contact to one or more signal wires of a headphone cable and at least one contact that provides contact to at least one reference line of the headphone cable, the pluggable filter assembly being to be connected to the connector of the headphone cable via the second pluggable assembly connector;

an electronic filter configured to perform a filtering effective on at least one of the signal wires and the reference line of the headphone cable, wherein frequencies of a VHF radio band are passed and at least one frequency band below or above the VHF radio band is attenuated, the electronic filter being connected to the first and the second pluggable assembly connectors, the electronic filter being provided between the first and the second pluggable assembly connectors; and an assembly case housing the electronic filter and connections between the electronic filter and the first and the second pluggable assembly connectors.

2. The pluggable filter assembly according to claim 1, wherein the electronic filter is effective on the at least one reference line.

3. The pluggable filter assembly according to claim 1, wherein the electronic filter is effective on one or more of the signal wires and reference lines of the headphone cable.

4. The pluggable filter assembly according to claim 1, wherein the electronic filter is effective on all of the signal wires and reference lines of the headphone cable.

5. The pluggable filter assembly according to claim 1, wherein the electronic filter is a passive common mode filter comprising inductors and/or coils.

6. The pluggable filter assembly according to claim 1, wherein the electronic filter is configured to attenuate frequencies between an audible range and the VHF radio band to a higher degree than frequencies within the audible range and the VHF radio band.

7. The pluggable filter assembly according to claim 1, wherein the VHF radio band has a width between 14 and 21 MHz.

8. The pluggable filter assembly according to claim 1, wherein the VHF radio band contains a frequency of 90 MHz.

9. The pluggable filter assembly according to claim 1, wherein the second pluggable assembly connector matches with the first pluggable assembly connector.

10. The pluggable filter assembly according to claim 1, wherein the first pluggable assembly connector is a male connector and the second pluggable assembly connector is a female connector.

* * * * *